United States Patent [19]

Nakahara

[11] 4,142,354

[45] Mar. 6, 1979

[54] DIRECT SPINNING APPARATUS

[75] Inventor: Teiju Nakahara, Ujishi, Japan

[73] Assignee: Murata Kikai Kabushiki Kaisha, Japan

[21] Appl. No.: 835,339

[22] Filed: Sep. 21, 1977

[30] Foreign Application Priority Data

Mar. 24, 1977 [JP] Japan ..... 52-32968

[51] Int. Cl.[2] ..... D01H 7/90; D01H 1/12

[52] U.S. Cl. ..... 57/328; 57/333; 57/58.89; 57/350

[58] Field of Search ..... 57/34 R, 34 B, 58.89–58.95, 57/157 F

[56] References Cited

U.S. PATENT DOCUMENTS

| | | | |
|---|---|---|---|
| 2,926,483 | 3/1960 | Keeler et al. | 57/58.95 |
| 2,928,228 | 3/1960 | Gotzfried | 57/58.89 |
| 3,826,073 | 7/1974 | Hoeber et al. | 57/58.89 X |
| 3,848,403 | 11/1974 | Bobkowicz et al. | 57/58.89 X |
| 3,945,185 | 3/1976 | Nakamura et al. | 57/58.95 |
| 3,978,648 | 9/1976 | Tamagatu et al. | 57/157 F X |
| 3,981,137 | 9/1976 | Fehrer | 57/58.89 X |

*Primary Examiner*—Charles Gorenstein
*Attorney, Agent, or Firm*—Whittemore, Hulbert & Belknap

[57] ABSTRACT

Apparatus and method for directly obtaining a spun yarn from slivers. The apparatus comprises a drafting device for the sliver, a first fluid turning nozzle, a false twisting device rotating in a direction opposite to the turning direction of the fluid turning nozzle and a take-up means.

6 Claims, 16 Drawing Figures

FIG. 1
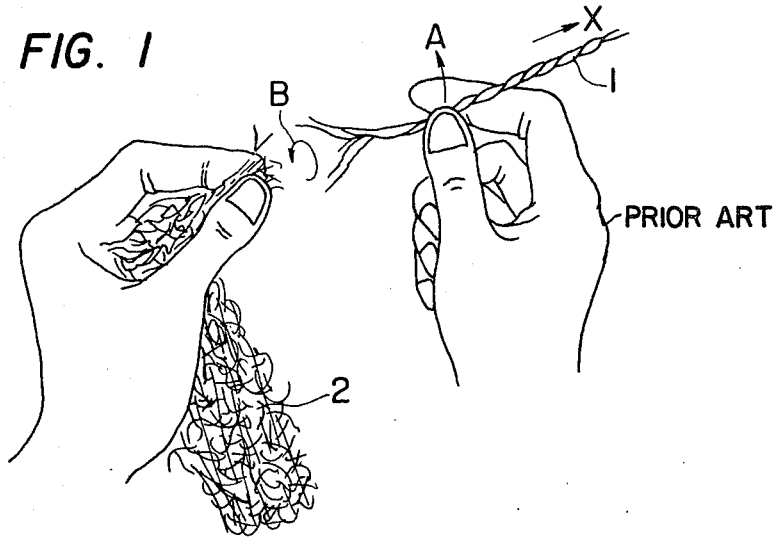
FIG. 2-a
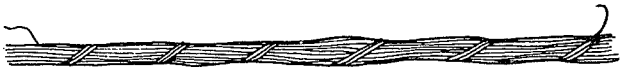
FIG. 2-b
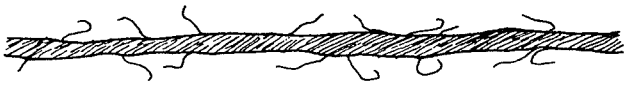
FIG. 2-c
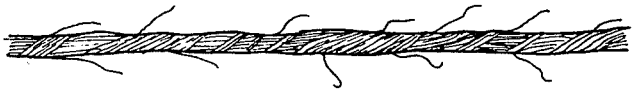
FIG. 3
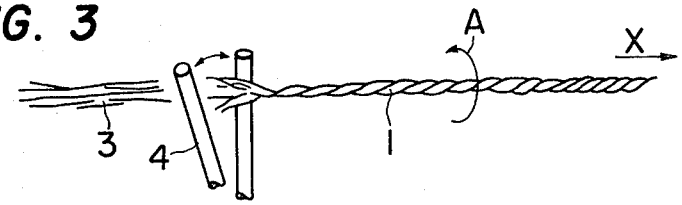
FIG. 4
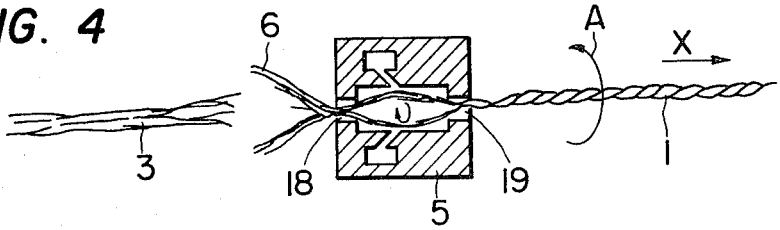

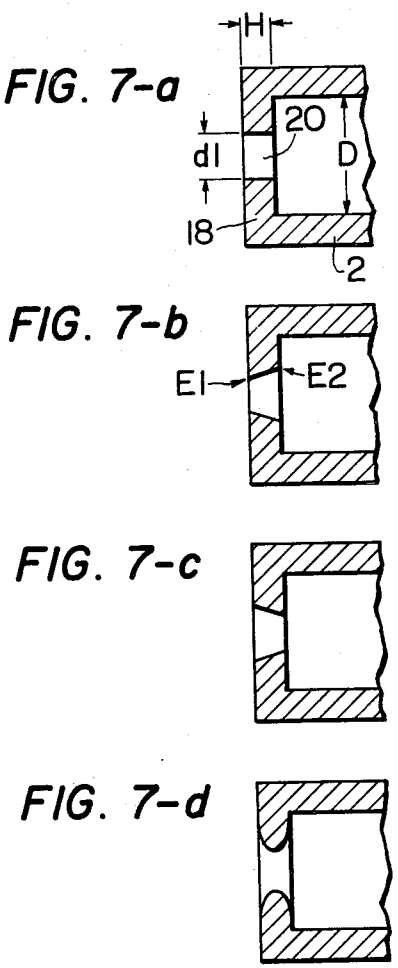
FIG. 7-a FIG. 7-b FIG. 7-c FIG. 7-d
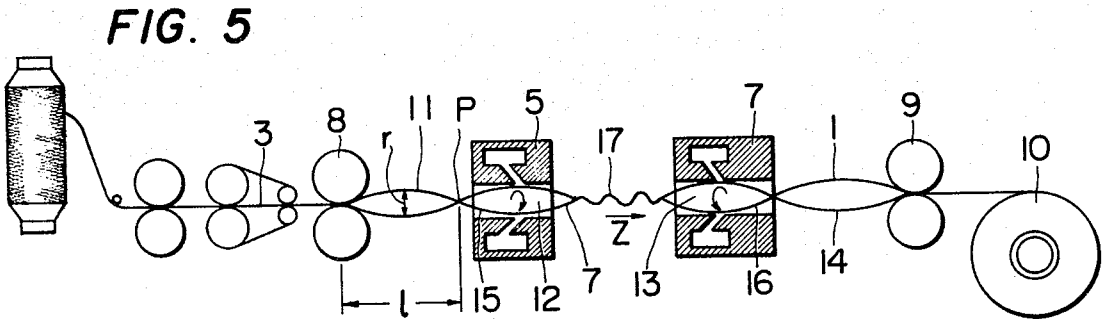
FIG. 5
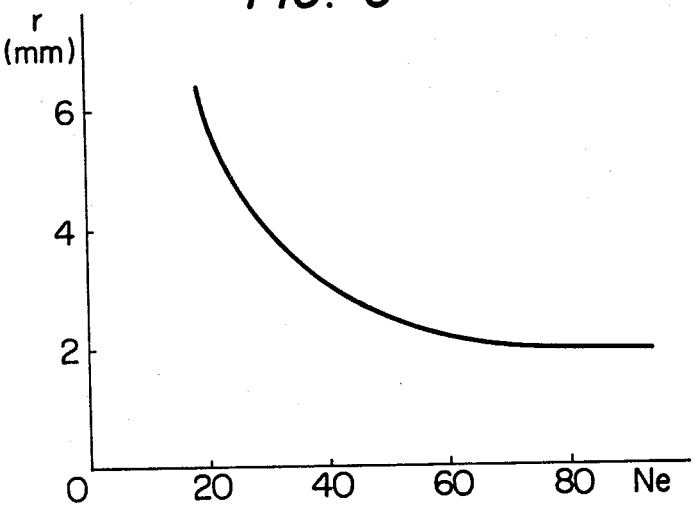
FIG. 6

FIG. 8-a
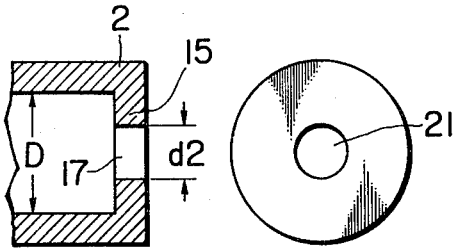
FIG. 8-b
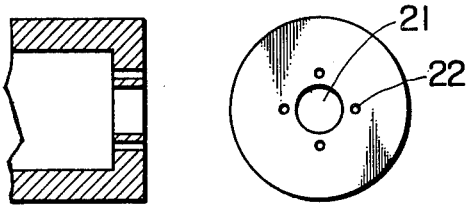
FIG. 8-c
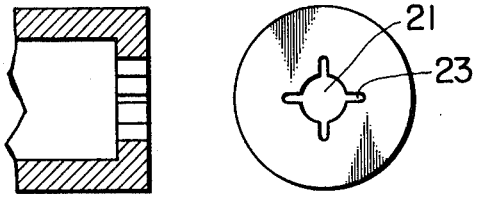
FIG. 9
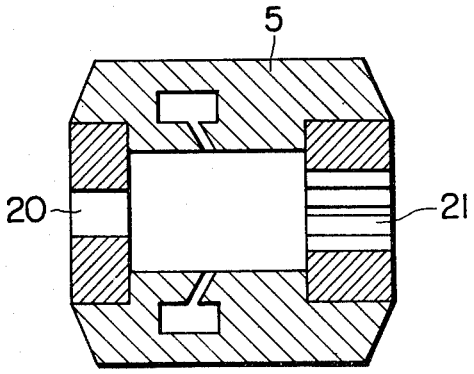

DIRECT SPINNING APPARATUS

BACKGROUND OF THE INVENTION

Historically, our ancestors formed yarns manually from masses of wool or cotton. The principle of a highly developed spinning process originating from this manual spinning process through a great number of various advances and improvements is attributed to this simple manual operation.

When our ancestor prepared a yarn with his own hands, as shown in FIG. 1, he picked up the yarn end by fingers of the right hand and turned the yarn between the thumb and forefinger to impart twists to the yarn, while he had a cotton mass on the left hand and picked it up to supply fibers. It is construed that this simple operation includes the following four spinning methods.

The first method is one in which the formed yarn is being entirely rotated and it is pulled to the right (in the X direction) without disconnecting the yarn from cotton, to impart true twists to the yarn. This method is known as the ring spinning. It is known that in this method, the amount of the yarn wound is limited and since the yarn is rotated, also the spinning speed is limited (the spinning speed being 13 m/min in case of cotton count Ne 45). As will readily be understood from the fact that cotton counts Ne of yarns heretofore used through our long history have been in the range of 10 to 100, this spinning method has provided us with high quality yarns for our clothing articles.

The second method is one in which a cotton mass is rotated contrary to the first method in which the yarn is rotated. This method can be worked theoretically, but this method has not been practically worked.

The third method is a modification of the second method in which very small amounts of fibers are separated from a cotton mass in succession and thus supplied, and the so supplied fibers are caught on the end of the spun yarn and the yarn end is freely rotated, to form an actually twisted spun yarn. This method is known as the open-end spinning method. Some methods embodying this princple, which differ in the manner of separating small amounts of fibers in the free state from the cotton mass, are known in the art. As a typical instance, there can be mentioned a rotor type open-end spinning process disclosed in the specification of U.S. Pat. No. 3,368,340. More than 5000 spinning machines according to this rotor type open-end spinning process have been practically worked in the art, but in view of working results obtained in these 10 years, it has been confirmed that it would be difficult to enhance the spinning speed because of limitations imposed on the energy consumption and yarn quality. Further, from the economical and technical viewpoints, it is said that preferred cotton counts Ne are in the range of 6 to 45, and it is construed that it is very difficult to spin yarns finer than those of cotton count Ne 40. Moreover, because of the tenacity and structure of the spun yarn, the final application range of the yarn spun according to this spinning process is considerably limited. However, as compared with the first-mentioned ring spinning process, is advantageous with respect to the spinning speed (the yarn speed being 40 m/min on the supposition that the cotton count is Ne 45 for comparison with the ring spinning process where the popular cotton count is Ne 45). In another instance of the open-end spinning process disclosed in the specification of U.S. Pat. No. 3,851,455, fibers are gathered in the form resembling a rope thrown by a cowboy, and the principle of this spinning process is not substantially different from the above-mentioned rotor type open-end spinning process in connection with the fiber-gathering manner, but since pneumatic fluids are utilized, the spinning speed can be enhanced (110 m/min on the supposition that the cotton count is Ne 45 for comparison with the ring spinning process where the popular cotton count is Ne 45). It is said that applicable cotton counts are in the range of from Ne 10 to Ne 30.

The fourth method is one in which either the cotton mass or the resulting yarn is rotated, the connection of fibers to the resulting yarn is not broken, and false twists are given to the resulting yarn to move the fibers and recover the spun yarn. This method is known as the false-twisting process. Typical instances of this spinning process are disclosed in the specifications of U.S. Pat. Nos. 3,079,746 and 3,978,648. According to these known processes, free fibers are actually twisted and wrapped on a non-twisted core yarn. Accordingly, it is indispensible that the cotton mass is sufficiently expanded to form free fibers, and expanded ribbon bundles are supplied in parallel to one another and are taken up by a suction device and twisted by a false-twisting device. The spinning process of this type is in agreement with the ring spinning process in the point that the connection state is substantially maintained between the mass of fibers and yarn, but it is different from the ring spinning process in the point that the formed yarn is not entirely rotated. From the above-mentioned specifications it is seen that in this false-twisting process, the spinning speed is very high, but the process inevitably involves a defect that since fibers are merely wrapped and wound on the core yarn, the yarn strength is insufficient. In the self-twisting process disclosed in the specification of U.S. Pat. No. 3,443,370, a yarn is formed by mechanical false-twisting. It is said that applicable counts are in the range of Ne 12 to Ne 40 and the spinning speed is high (200 m/min on the supposition that the count is Ne 45 for comparison with the ring spinning process where the popular count is Ne 45).

SUMMARY OF THE INVENTION

The present invention relates to a novel apparatus and method for directly obtaining a spun yarn from slivers.

According to the present invention, a drafting device of the known spinning machine, one fluid turning nozzles, one false twisting device and one winding device are disposed and slivers are supplied from a front roller of the drafting device. In the direct spinning apparatus, connection between fibers of a sliver continuously supplied from said front roller and spun yarn is broken by revolution of the yarn by the balooning of the yarn caused by the fluid turning nozzle and while fibers thus supplied are caught at the yarn end by rotation of a yarn upon false twists imparted to the yarn by means of the false twisting device, whereby twists formed by rotation of the yarn are released from the end of the yarn and the actually twisted yarn is directly obtained from the sliver.

This direct spinning apparatus of the present invention comprises a front roller of a drafting device, a drafting device, a first fluid turning nozzle having at yarn inlet and outlet throttled hole portions having a size smaller than that of a yarn passage perforated through the nozzle, a false twisting device rotating in a direction opposite to the turning direction of a yarn balloon from the first fluid turning nozzle and a take-up roller.

BRIEF DESCRIPTION OF THE DRAWINGS

FIG. 1 is a view illustrating the principle of spinning;

FIGS. *2a* – *2c* are expanded views showing a ring-spun yarn, a false-twisted yarn and a spun yarn according to the present invention respectively;

FIG. 3 is a view illustrating the principle of the present invention;

FIGS. 4 and 5 are partly diagrammatic sectional views showing embodiments of the present invention;

FIG. 6 is a graphical illustrating the relation between a diameter of a balloon and counts of spun yarn in practicing the present invention;

FIGS. *7a* – *7d* illustrate examples of the throttled portion on the inlet side of the first fluid turning nozzle of the present invention;

FIGS. *8a* – *8c* illustrate examples of the throttled portion on the outlet side of the first fluid turning nozzle of the present invention; and FIG. 9 is a sectional view showing one example of the fluid turning nozzle of the present invention.

DETAILED DESCRIPTION OF THE INVENTION

The present invention will now be described in detail by reference to the accompanying drawing.

Referring now to FIG. 1, the principle of the present invention is described. The yarn 1 is turned between the thumb and forefinger of the right hand to impart twists thereto. If the yarn is seen in the stationary state, the twists are generated in both the left and right directions with the point picked up by the thumb and forefinger being as the boundary. The cotton mass 2 is held by the left hand, and small amounts of fibers are supplied by the thumb and forefinger. In this case, the end of the yarn being rotated by the right hand is turned in the direction of an arrow A and twists are released from the yarn end. At this point, it is necessary that the yarn end should be in the open state separated from fibers of the cotton mass 2. At this moment, the fibers are supplied to the yarn end and are twisted thereinto. Accordingly, in the present invention, a yarn is continuously spun by synchronizing the three conditions, namely feeding of fibers, rotation of the yarn, and release of twists from the yarn end kept in the open state. More specifically, as will readily be understood from a simple experiment, rotation of the yarn 1 makes a function of catching fibers at the yarn end, and when the yarn is moved by the right hand in a direction tearing the yarn from the cotton mass, a function of breaking the connection between the yarn and the fibers of the cotton mass is manifested. The left hand performs a function of supplying fibers in amounts suitable for a desirable yarn thickness. Accordingly, what is most important is that the yarn end is kept in the open state, and of left and right twists generated by the fingers of the right hand, twists on the left side, namely on the side of the cotton mass, are released from the open end of the yarn and actual twists are left in the yarn being formed.

FIG. 3 is a fundamental embodiment of the present invention, which is derived from the manual spinning process illustated in FIG. 1. In this embodiment, the yarn is continuously spun unlike in the manual process. The yarn 1 is rotated in a direction of arrow A by a rotor customarily utilized in a known false-twisting machine or the like or by a pneumatic force. In order to separate or disconnect the yarn 1 from a sliver 3 supplied by a conventional drafting device customarily used in a conventional ring spinning machine according to a customary method, a high speed vibrating member 4 is disposed. The yarn 1 is taken up in a direction of arrow X by a known take-up roller and is then wound. In the high speed vibrating member 4, pins may be planted on a disc to break the connection between the yarn end and fibers. This high speed vibrating member 4 performs, together with the yarn balloon, the function of the right hand in FIG. 1, namely the function of pulling the yarn.

In the embodiment shown in FIG. 4, a fluid turning nozzle 5 is used as the high speed vibrating member 4. Any of known rotors can be used for imparting twists to the yarn 1 as in the embodiment shown in FIG. 3. More specifically, any of known pin type or, friction type or, gripper type twisting means and fluid turning nozzles can be used, and these known means are inclusively called "false twisting devices." Any gas can be used as the fluid to be supplied to the fluid turning nozzle, but it is advantageous to use compressed air which is easily available. Although the high speed vibrating member 4 directly beats the connection point between the yarn end and the fibers in the embodiment shown in FIG. 3, a balloon generated in the fluid nozzle, i.e., revolution of the yarn, acts together with the yarn shrinkage by twisting so that the connection between the fibers and the yarn will be broken. In this case, it is construed that inclination of the jetting opening of the nozzle to the yarn passage will participate in this action though to a very small extent. However, it is difficult to express the influence of this inclination on the connection-breaking action, i.e., the opening action, and therefore, it is now tentatively said that the inclination angle is preferably up to 90°. It is also construed that rotation of the yarn by twists given to the yarn will be slightly influenced by false twists caused by the contact of the yarn with the nozzle or other member. By the balloon of a certain shape formed in the interior of the nozzle, the yarn end 6 is caused to form a balloon of a certain shape, and control of the balloon in the interior of the nozzle results directly in control of the balloon of the yarn end 6. In the embodiment shown in FIG. 4, rotation of the yarn is effected in the direction of arrow A by the false twisting device, and the resulting twists are shifted to the yarn end 6. It must be noted that this rotation of the yarn is caused by the fluid turning nozzle 5. The turning direction of the fluid swirling nozzle 5 is opposite to the direction of twists given to the yarn by the false twisting device. Namely, a braking action is imposed on the function of twisting the fibers into the yarn. Of course, in the embodiment shown in FIG. 4, an adjustment device is disposed to synchronize the rotation speed of the yarn 1 with the running speed of the yarn 1. This synchronizing adjustment will easily be accomplished by those skilled in the art based on simple experiments by using a known device.

In the embodiment shown in FIG. 5, fluid turning nozzles are used for the high speed vibrating member 4 and the yarn-twisting device 7 shown in FIG. 4. Of course, other twisting devices and fluid turning nozzles may be used instead.

A sliver 3 taken out by a sliver take-out roller 8 is passed through two fluid turning nozzles 5 and 7 turning in directions opposite to each other and thus processed into a yarn 1. The yarn 1 is taken out by a yarn take-out roller 9 and wound on a bobbin 10 by a known winding device.

The first fluid turning nozzle 5 generates a balloon and the second fluid turning nozzle 7 imparts twists to the yarn. By the turning action of the balloon 11 generated by the nozzle 5, the sliver 3 flattened by a front roller 8 is turned up and down and to the left and right and the connection between the fibers 3 and yarn 1 is broken. At this point, a pin or needle can be passed across the connection point between the fibers and yarn being spun. It is construed that this fact proves that the spinning process of the present invention differs from the fourth method — description will be followed —, namely the false twisting spinning process. By this end-opening operation, false twists given to the yarn by the false twisting device 7 are released and actual twists in an amount corresponding to the amount of the thus released twists are left in the yarn. In this manner, a yarn in which true twists are inserted even into the core in a certain direction is formed.

In the embodiment shown in FIG. 5, each of nozzle has yarn passages 12 and 13 respectively, which are drawn as a cylindrical passage, and the balloon generated by the nozzle 5 and the balloon generated by the nozzle 7 are restricted by the diameters of the passages 12 and 13. When the balloon sizes are larger than the diameters of the passages 12 and 13, second balloons 11 and 14 are formed on the right side of the balloon 15 and on the left side of the balloon 16, respectively. Since the rotation directions of the nozzles 5 and 7 are opposite to each other, they interfere with each other in the portion 17. The point P of conversion between the balloon 11 and the balloon 15 is generated on the left side of a balloon-generating device 5. The balloon is generated along a distance l between the front roller 8 and this conversion point P. This conversion point P is changed by not only the yarn thickness, the yarn speed and the fluid pressure but also other factors such as interferences 17 of the balloon from the nozzle 7 and the balloon from the nozzle 5.

As pointed out hereinbefore, the balloon 11 is controlled by controlling the balloon 15. Conditions to be applied to the balloon 11 will now be described.

It was found that spinning according to the present invention is possible when the rotation number of the balloon 11 is at least 60000 rpm.

As a result of experiments, it was confirmed that in case of a cotton count Ne 45, conditions to be applied to the balloon 11 so as to enable the open-end spinning according to the present invention are that the distance l between the sliver take-out roller 8 and the balloon conversion point P is 10 to 12 mm and the rotation number of the balloon generated between the sliver take-out roller 8 and the conversion point P is at least 60000 rpm. The relation between the diameter of the balloon and counts of yarn is illustrated in FIG. 6.

In the present invention, it cannot but be said that it is fundamentally important to stabilize this balloon 11. Accordingly, it is desired to stabilize the balloon 11 against variations of the diameter of the yarn on the side of the front roller 8, though the count of the yarn as a varying factor on the side of the front roller 8 remains to be studied. In connection with the structure of the nozzle 5 as means for generating the balloon 11, the nozzle 5 used in the embodiment shown in FIG. 4 is proposed as a fundamental type.

This nozzle is characterized in that throttled portions 18 and 19 are formed on the yarn inlet and outlet, respectively.

Examples of the throttle portion 18 on the inlet side are illustrated in FIGS. 7-*a*, 7-*b*, 7-*c* and 7-*d*, and examples of the throttled portions on the outlet side are illustrated in FIGS. 8-*a*, 8-*b* and 8-*c*.

The hole diameter *d*1 of the throttled portin 18 is smaller than the diameter D of the yarn passage 12. Accordingly, even if the diameter of the balloon 15 is changed for some reason in the embodiment shown in FIG. 5, the conversion point P is prevented from shifting by the throttled portion 18 and the balloon 11 can be stabilized. Examples shown in FIGS. 7-*a* to 7-*d* are different from one other in the point that the shape of the hole 20 is cylindrical, truncated-conical, reverse trustoconical or portly. Among these hole shapes, it is preferred that each of edges E1 and E2 be rectangular. From experiments it has been confirmed that the hole shape shown in FIG. 7-*a* is most preferred for stabilizing the balloon. Of course, for prevention of damages of the yarn and other preparation reasons, edges E1 and E2 are rounded to some extent. The shape shown in FIG. 7-*c* is next preferred, and the shapes shown in FIGS. 7-*b* and 7-*d* come next. It was found that in order to attain a good open-end stably in the balloon 11, the size H is preferably 3 to 5 mm. Generation of false twists can be expected by the contact of the ballooning yarn with this throttled portion, but since an abrasion-resistant ceramic material is used, this contact will make no great contribution to generation of false twists.

The hole diameter *d*2 of the throttled portion 19 on the outlet side is smaller than the diameter D of the yarn passage 12, and even if variations are caused on the balloon 15, the balloon generated on the right side of the nozzle 5 is stabilized and the throttled portion 19 acts as a barrier for varying elements from the interferring portion 17. Of course, since the fluid is jetted from the nozzle 5 obliquely to the yarn advance direction (the direction Z in FIG. 5) and tangentially to the yarn passage, in order to enhance the effectiveness of the fluid, it is preferred that the sectional area of the hole 20 on the inlet side. Exampls of the hole 21 having a larger sectional area are shown in FIGS. 8-*a* to 8-*c*. In FIG. 8-*a*, the diameter of the hole 21 is increased over the diameter of the hole 20, in FIG. 8-*b*, small holes 22 are additionally formed around the hole 21, and in FIG. 8-*c* grooves 23 are formed around the hole 21. It cannot be said that any of these examples is especially preferred, but in order to stabilize the balloon effectively, it is preferred that the diameter of the hole 17 be not too large. Any of shapes as shown in FIGS. 7-*a* to 7-*d* may be adoped for the hole 21, and a cylindrical shape is most preferred.

A nozzle comprising the throttled portions shown in FIGS. 7-*a* and 8-*c* is illustrated in FIG. 9.

The nozzle 5 having this structure was applied to the embodiment shown in FIG. 5 and operation data were collected.

More specifically 1 kg of a sliver was taken out while changing the distance l between the take-out roller 8 and the throttled portion 18, and the frequency of yarn breakages and the tenacity of the resulting yarn were measured to obtain results shown in Table 1.

Table 1

| Distance l (mm) | Yarn break frequency (per kg of sliver) | Yarn tenacity |
|---|---|---|
| 8 | 3 | 180 |
| 9 | 1 | 200 |
| 10 | 0.1 | 280 |
| 11 | 0.1 | 280 |
| 12 | 0.1 | 280 |
| 13 | 1 | 260 |
| 14 | 2 | 250 |
| 15 | 3 | 240 |
| 20 | 5 | 150 |

As will readily be understood from the results shown in Table 1, the spinning process of the present invention can be performed in good conditions when the distance l is in the range of 10 to 12 mm.

The relation between the cotton count Ne and the diameter r of the balloon 11, which would provide optimum spinning conditions, was searched for to obtain results shown in FIG. 6 in which the abscissa denotes the cotton count Ne and the ordinate represents the diameter r of the balloon 11.

As a result, it was found that the following relation will provide optimum conditions:

$$r \approx \frac{10}{10^{0.02Ne}} + 1.68$$

When this relation was established, in case of a 65/35, polyester/cotton, mixed sliver, a spun yarn having a tenacity of 280 g was obtained at a cotton count Ne 45. The spinning speed was 150 m/min.

Fibers that can be used in the present invention include natural fibers such as cotton, wool, silk, ramie, flax, jute and hemp fibers and synthetic fibers such as polyester, polyamide, acrylic, polyethylene, polypropylene and polyvinyl fibers.

As will be apparent from the foregoing illustration, the spinning speed is as high as 150 to 200 m/min and the spun yarn count Ne is in the range of from 10 to 70. Whether filaments or staple fibers may be used, yarns having a high tenacity can be obtained. Further, the yarns prepared according to the present invention can be applied to substantially all of final products, and the spinning can be accomplished without substantial generation of noises. Moreover, the spinning apparatus of the present invention can be worked in the conventional spinning process without substantial improvement or modification.

It is not known in which known type of the four spinning method described as the prior art the present invention should be included, but it is possible to compare the present invention with any of the foregoing spinning methods.

The present invention is first compared with the first method. Since the spun yarn obtained according to the present invention is a truly twisted yarn, the structure of the resulting yarn is similar to the structure of the yarn spun according to the first method. However, the first method is different from the present invention where the resulting yarn is connected to fibers and this connection is broken without rotating entirely the wound spun yarn. The present invention is advantageous over the ring spinning process in the point that the spinning speed is 180 m/min in case of the cotton count Ne 45 and is higher than the spinning speed in the ring spinning process. In connection with the yarn breakage frequency and yarn tenacity, the present invention is similar to the ring spinning process.

When the spinning process of the present invention is compared with the third method, it is seen that the present invention is different from the open-end spinning process where small quantities of fibers are separated from a cotton mass and formed into rings, but as in the ring spinning process, yarns are directly prepared from a cotton mass in the present invention. In the case of the open-end spinning process forming rings of fibers, attentions must be paid to disposal of leaves, seeds and dusts contained in cotton, but in the present invention, such care need not be taken at all. Moreover, the drafting device in the conventional ring spinning machine can be directly used without any modification for practicing the present invention, which yields an advantage that the existing ring spinning machine can be utilized only after minor modification. The present invention is similar to the third method in the point that the resulting yarn is a truly twisted yarn, but is different from the third method in the point that the yarn tencacity is high and the applicable count (Ne 10 to 70) can be broadly changed in the present invention. Moreover, the spinning speed is 150 to 200 m/min in the present invention, which is different from the spinning speed in the open-end spinning process.

When the present invention is compared with the fourth method, it is seen that the present invention is partially similar to the fourth method, but is different in the following point. The yarn obtained according to the present invention is a truly twisted yarn in which a layer separation of the core bundle and the surface wrapping seen in a fascinated yarn is not observed at all. This difference will readily be understood fron FIGS. 2-*a* to 2-*c* where FIG. 2-*a* represents a fascinated yarn, FIG. 2-*b* represents a ring-spun yarn and FIG. 2-*c* represents an AVS yarn (tentatively named) according to the present invention. In the fascinated yarn, an endless bundle of fibers is wrapped around a core, and therefore, the yarn tenacity is low and it is construed that no sufficient yarn tenacity will be expected unless the unit fiber has a considerable length. Moreover, the difference will also be apparent from the fact that in arranging nozzles in the present invention, it is unnecessary to arrange the sliver in the form of a ribbon but the yarn is rather rounded on the inlet side of the nozzle.

What is claimed is:

1. A direct spinning apparatus comprising a drafting means including a front roller, a first fluid turning nozzle having a cylindrical yarn passage perforated therethrough and throttled hole portions having a size smaller than that of the yarn passage on yarn inlet and outlet sides thereof, a false twisting device for rotating a yarn in a direction opposite to the turning direction of a yarn balloon imparted by the first fluid turning nozzle, and a take-up means.

2. A direct spinning apparatus as set forth in claim 1 wherein the throttled portion on the yarn inlet side of the first fluid turning nozzle has a cylindrical hole shape.

3. A direct spinning apparatus as set forth in claim 1 wherein a cross-sectional area of the hole of the throttled portion on the yarn inlet side of the first fluid turning nozzle is smaller than a cross-sectional area of the hole of the throttled portion on the yarn outlet side of the first fluid turning nozzle.

4. A direct spinning apparatus as set forth in claim 1 wherein the diameter of the hole of the throttled portion on the yarn inlet side of the first fluid turning nozzle is the same as that of the throttled portion on the yarn outlet side thereof and a plurality of small holes are additionally formed around the hole on the outlet side.

5. A direct spinning apparatus as set forth in claim 1 wherein said false twisting means is constructed as a fluid turning nozzle.

6. A direct spinning method for producing an actually spun yarn using an apparatus comprising a drafting means including a front roller, a first fluid turning nozzle having a cylindrical yarn passage perforated therethrough and throttled hole portions having a size smaller than that of the yarn passage on yarn inlet and outlet sides thereof, a false twisting device for rotating a yarn in a direction opposite to the turning direction of a yarn balloon imparted by the first fluid turning nozzle, and a take up means, including the steps of continuously supplying fibers from the front roller to the first fluid turning nozzle and drawing the fibers into a yarn between the front roller and first fluid turning nozzle, turning the yarn by the first fluid turning nozzle to cause ballooning and revolution of the yarn whereby connection between the yarn and fibers is loosened and broken and twists imparted by rotation of the yarn are released from the broken end of the yarn to give the yarn actual twists, imparting false twists to the fibers of the yarn by the false twisting device whereby fibers are caught at the yarn end and taking up the produced spun yarn on a package.

* * * * *